US006589404B1

(12) United States Patent
Anastasijevic et al.

(10) Patent No.: US 6,589,404 B1
(45) Date of Patent: Jul. 8, 2003

(54) ELECTROLYTIC CELL FOR ELECTROCHEMICALLY DEPOSITING ONE OF THE FOLLOWING METALS, COPPER, ZINC, LEAD, NICKEL OR COBALT

(75) Inventors: Nikola Anastasijevic, Altenstadt (DE); Stefan Laibach, Geismar (DE); Reinhard Dobner, Lünen (DE); Helmut Schatton, Lünen (DE)

(73) Assignee: MG Technologies AG, Frankfurt/Main (DE)

( * ) Notice: Subject to any disclaimer, the term of this patent is extended or adjusted under 35 U.S.C. 154(b) by 0 days.

(21) Appl. No.: 09/787,089

(22) PCT Filed: Sep. 7, 1999

(86) PCT No.: PCT/EP99/06583

§ 371 (c)(1),
(2), (4) Date: Apr. 20, 2001

(87) PCT Pub. No.: WO00/15874

PCT Pub. Date: Mar. 23, 2000

(30) Foreign Application Priority Data

Sep. 11, 1998 (DE) ..... 198 41 587

(51) Int. Cl.[7] ..... C25B 15/00; C25B 9/00; C25B 11/00

(52) U.S. Cl. ..... 204/237; 204/268; 204/269; 204/275.1; 204/278.5; 204/284

(58) Field of Search ..... 204/237, 268, 204/269, 275.1, 278.5, 284

(56) References Cited

U.S. PATENT DOCUMENTS

| | | | | |
|---|---|---|---|---|
| 3,451,914 A | * | 6/1969 | Colman | 204/237 |
| 3,876,516 A | * | 4/1975 | Pace et al. | 204/237 |
| 3,915,834 A | * | 10/1975 | Wright et al. | 204/242 |

FOREIGN PATENT DOCUMENTS

| | | |
|---|---|---|
| DE | 41 21 588 C1 | 4/1992 |
| EP | 0 146 732 A1 | 7/1985 |
| WO | WO 97/20087 | 6/1997 |

* cited by examiner

*Primary Examiner*—Stephen Kalafut
*Assistant Examiner*—Thomas H. Parsons
(74) *Attorney, Agent, or Firm*—Herbert Dubno

(57) ABSTRACT

The electrolytic cell has a trough-like container with a bottom, with side walls and with at least one inlet and at least one outlet for the electrolyte. Numerous plate-like electrodes are disposed in the container and are partly immersed in an electrolyte bath. The bottom of the container which is in contact with the electrolyte bath has numerous openings for the passage of electrolyte, and below the bottom there is disposed at least one distribution chamber for recirculated electrolyte. At least one of the side walls of the container is equipped with at least one recirculation chamber for recirculating electrolyte from the electrolyte bath into the distribution chamber, the upper portion of the recirculation chamber being connected with the electrolyte bath and the lower portion of the recirculation chamber communicating with the distribution chamber.

6 Claims, 1 Drawing Sheet

ELECTROLYTIC CELL FOR ELECTROCHEMICALLY DEPOSITING ONE OF THE FOLLOWING METALS, COPPER, ZINC, LEAD, NICKEL OR COBALT

DESCRIPTION

This invention relates to an electrolytic cell for the electrochemical deposition of one of the metals copper, zinc, lead, nickel or cobalt from an aqueous electrolyte containing the metal in ionogenic form, wherein the electrolytic cell has a trough-like container with a bottom, with side walls, and with at least one inlet and at least one outlet for the electrolyte, wherein numerous plate-like electrodes are disposed in the container and are partly immersed in an electrolyte bath, and wherein at least one anode and at least one cathode are connected with a direct current source.

Electrolytic cells of this type are known and described e.g. in DE-A-2640801, US-A-5720867 and DE-A-19650228. These cells include a single or only a few supply lines for the electrolyte, and attempts are made at conducting the electrolyte in the container in the desired way. From US-A-5720867, openings in the side walls are known, an electrolyte circulation being established inside a cell by means of bipolar electrodes.

It is the object underlying the invention to develop an electrolytic cell which is suited for current densities of several hundred and also more than 1000 $A/M^2$, and which can utilize the resulting vigorous formation of gas for conducting the electrolyte.

In the above-mentioned electrolytic cell, the object is solved in accordance with the invention in that the bottom of the container which is in contact with the electrolyte bath has numerous openings for the passage of electrolyte, that below the bottom there is disposed at least one distribution chamber for recirculated electrolyte, and that at least one of the side walls of the container has at least one recirculation chamber for recirculating electrolyte from the electrolyte bath into the distribution chamber, the upper portion of the recirculation chamber being connected with the electrolyte bath and the lower portion of the recirculation chamber communicating with the distribution chamber.

In the electrolytic cell in accordance with the invention, part of the electrolyte is constantly recirculated from the electrolyte bath via the recirculation chamber and the distribution chamber through the openings in the bottom of the cell into the bath and to the electrodes. This recirculation of electrolyte ensures that all electrode areas constantly intensively get in contact with the electrolyte, even if a vigorous formation of gas is inevitable at high current densities. In the recovery of copper, e.g. gaseous oxygen develops at the anodes, which oxygen moves upwards at the anode surfaces in the form of bubbles and escapes from the electrolyte bath. In the inventive cell, the formation of gas and the related mammoth pump effect are utilized to constantly draw electrolyte from the distribution chamber through the openings in the bottom into the electrolyte bath and thus effect a circulation of the electrolyte. The mammoth pump effect of the ascending gas is strong enough, so that an external pump for moving the electrolyte can be omitted. The electrolyte flowing upwards from the bottom of the cell prevents that at the surfaces of the electrodes a boundary layer too much depleted in electrolyte is formed.

The electrodes of the electrolytic cell may be monopolar or bipolar electrodes. Monopolar electrodes may for instance be formed by a simple sheet (e.g. of titanium).

Details of the formation of cells with bipolar electrodes are known e.g. from US-A-5720867 and DE-A-19650228. In the electrolytic cell, current densities in the range from 200 to 2000 $A/M^2$ are employed, and preferably the current density is at least about 1500 $A/m^2$.

Advantageously, at least half the electrodes have openings for the passage of electrolyte in the area which is immersed in the electrolyte bath. These openings improve the flow of electrolyte through the electrolyte bath to the recirculation chamber and thereby facilitate the circulation of electrolyte. Mostly, all electrodes are provided with such flow openings. The recirculation chamber for the electrolyte is disposed on at least one of the side walls of the container such that there is a certain distance from the point where the fresh electrolyte is supplied to the container from the outside. One possibility is to dispose the recirculation chamber at that side wall of the container which is nearest to the electrolyte outlet. It is, however, also possible to dispose recirculation chambers at those side walls of the container on which the electrodes are supported. Another possibility is to provide three side walls of the container with recirculation chambers. The recirculation chambers may also constitute single lines or passages through which the electrolyte flows downwards from the electrolyte bath below the bottom to the distribution chamber.

The numerous openings in the bottom of the container, through which the electrolyte flows upwards from the distribution chamber into the electrolyte bath, may have all kinds of shapes. The openings may for instance be round, oval or slot-shaped. Usually, it is ensured that 1 to 20% of the surface of the bottom consists of openings, the bottom surface area being calculated as a whole and without deduction of the cross-sectional areas of the openings. Mostly, the openings make at least 3% of the bottom surface area. Due to the intensive circulation of the electrolyte in the electrolytic cell it is possible to design the surfaces of the electrodes hanging in the electrolyte bath rather large. In particular, it is no longer necessary to ensure a relatively large distance between the electrodes and the bottom of the cell, so that electrolyte can uniformly flow towards all electrodes. In the inventive cell, the lower edges of the electrodes can have a distance from the bottom of only 5 to 50 mm.

Embodiments of the electrolytic cell will be explained with reference to the drawing, in which.

Figure 1:
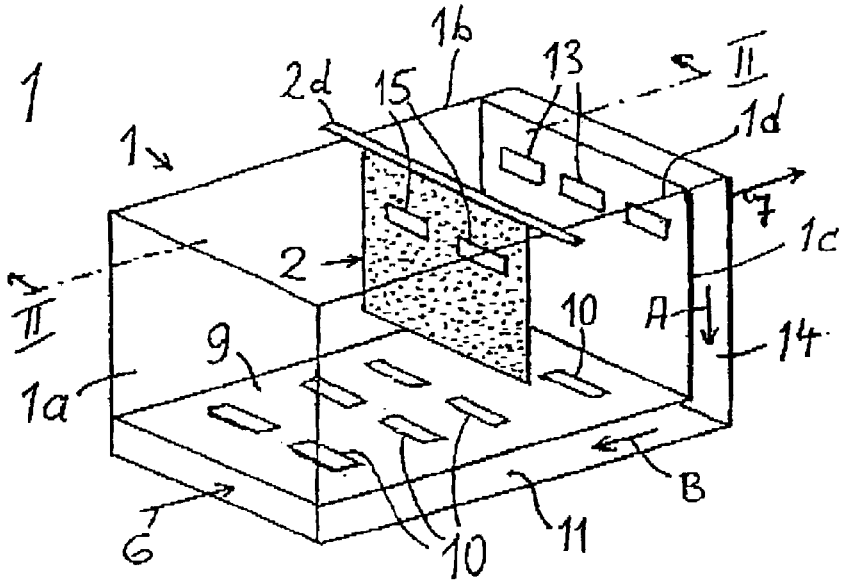
FIG. 1 shows the cell as glass model in a perspective representation.
Figure 2:
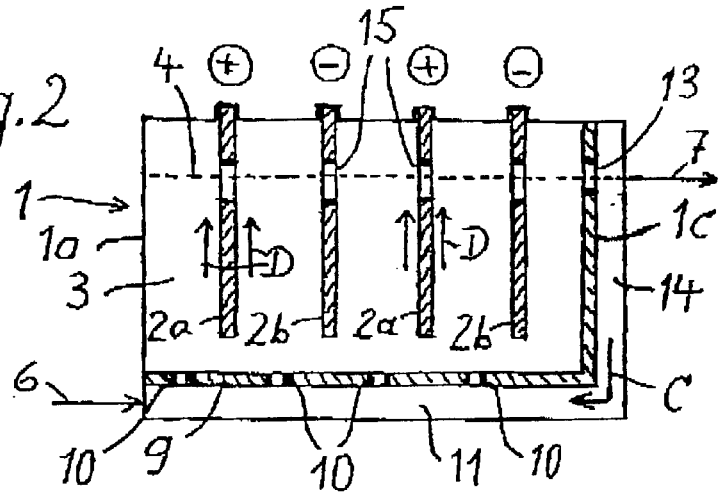
FIG. 2 shows a vertical section through the cell of FIG. 1 along line II—II.

The cell of FIGS. 1 and 2 has a trough-like container (1) and numerous plate-shaped electrodes (2). For a better clarity, only one electrode is represented in FIG. 1, and the same is dotted for optical emphasis. From FIG. 2 it can be taken that the cell is a cell with monopolar electrodes, anodes **(2*a*) and cathodes (2*b*) alternately hanging in the electrolyte bath (3). The electrodes have a horizontal supporting rod (2*d*), which is supported on the not represented conductor rails at the side walls of the container (1). The liquid level of the electrolyte bath (3) is indicated in FIG. 2 by a dotted line (4), and in FIG. 1 the electrolyte bath has been omitted. Fresh electrolyte is supplied through the inlet (6), used electrolyte is withdrawn through the outlet (7)**.

The container (1) comprises the bottom (9) with numerous .openings (10) and below the bottom a distribution chamber (11). In the variant of FIGS. 1 and 2, fresh electrolyte is introduced into the distribution chamber (11) through the inlet (6), but the inlet might alternatively also open into the electrolyte bath above the bottom (9).

The container (1) has four side walls (1*a*), (1*b*), (1*c*) and (1*d*). The side wall (1*c*), which is nearest to the outlet (7), is provided with openings (13), through which electrolyte can flow from the electrolyte bath (3) into the recirculation chamber (14) disposed behind the same. At the lower end, the recirculation chamber (14) verges into the distribution chamber (11) without flow obstacle. The electrolyte can thus flow downwards from the recirculation chamber into the distribution chamber (11), as is indicated by the flow arrows A, B and C.

The circulation of the electrolyte is effected alone by the formation of gas during electrolysis. These gas bubbles ascend at the anode (2), as is indicated by the arrows D in FIG. 2. To ensure that the electrolyte can circulate as freely as possible, the electrodes are provided with openings (15) in the vicinity of the electrolyte bath (3). Under the mammoth pump effect of the ascending gases, the electrolyte is thus drawn upwards from the distribution chamber (11) through the openings (10) in the bottom (9) into the electrolyte bath (3) and, flowing horizontally through the openings (15) in the electrodes, can get through the openings (13) into the recirculation chamber (14). Usually, it will be ensured that the amount of electrolyte flowing upwards through the bottom (9) is 2 to 20 times as large as the amount of fresh electrolyte supplied via line (6). As material for the container (1) plastics such as polyester, polypropylene or polyvinylchloride may be used, and the polymer concrete known per se can also be used.

When the openings (10) in the bottom (9) are slot-shaped, the slots may for instance have an opening area of 3×500 mm and thus be rather narrow. The depth of the slot and thus usually also the thickness of the bottom (9) will preferably lie in the range from 50 to 200 mm. Otherwise, the openings (10) may, however, also be round or oval in shape.

Figure 3:
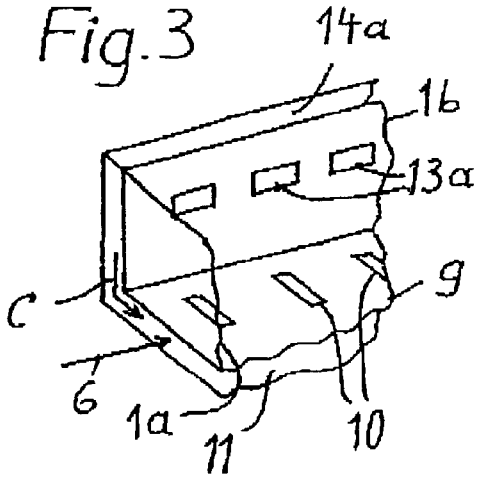
FIG. 3 shows a variant of the cell container in the form of cut-away glass model.

In the variant of FIG. 3, the recirculation chamber (14*a*) is disposed behind the side wall (1*b*), this side wall being provided with through holes (13*a*). As shown in FIG. 3, like in FIGS. 1 and 2, the distribution chamber (11) communicating with the recirculation chamber (14*a*) is disposed below the bottom (9). The electrodes (2) are supported on the side wall (1*b*), as is represented in FIG. 1. In an arrangement as shown in FIG. 3, the opposing side walls (1*b*) and (1*d*) (cf. FIG. 1) are expediently in the same way provided with recirculation chambers, in order to ensure a symmetrical flow distribution in the electrolyte bath. Another recirculation chamber behind the side wall (1*c*), as it is represented in FIG. 1, is like-wise possible in the variant of FIG. 3, or such recirculation chamber can be omitted.

Figure 4:
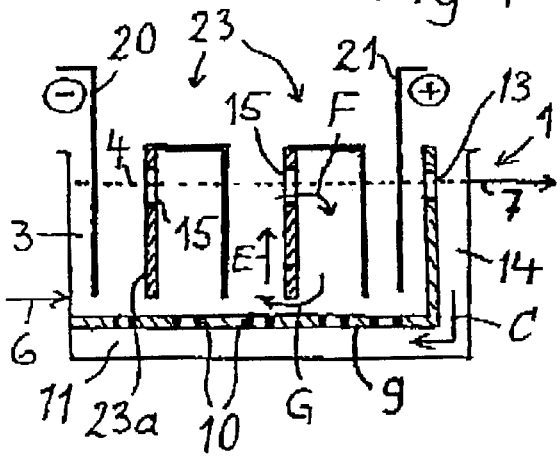
FIG. 4 shows the vertical section through a cell with bipolar electrodes.

In the schematically represented container (1) of FIG. 4, a terminal cathode (20) and a terminal anode (21) and between the same two bipolar electrodes (23) are provided. The terminal cathode and the terminal anode are connected to a not represented direct current source. In the vicinity of the electrolyte level (4), the anode sides (23*a*) of the bipolar electrodes have flow openings (15), so that the electrolyte can flow vertically along the arrows E, F and G around the anode side (23*a*). In addition, this cell is also provided with a recirculation chamber (14) and a distribution chamber (11) as well as with openings (10) in the bottom (9), whereby here as well the above-described electrolyte circulation takes place in addition. The bipolar electrodes may be separable, where the part carrying the deposited metal can be withdrawn from the bath (3), while the other part of the respective electrode (23) remains in the bath. The bipolar electrodes designed in this way are described in detail in DE-A-196 50 228.

EXAMPLE

An electrolytic cell built for test purposes has a container (1) of polymer concrete, as it is described in conjunction with FIGS. 1, 2 and 4. The rectangular surface of the bottom (9) has the dimension 1×3.2 m, the container has a height above the bottom (9) of 1.4 m. 6.8% of the bottom surface are provided with slot-shaped openings (10), the slot width being 3 mm. In the electrolyte bath, 20 bipolar electrodes (23) of titanium are hanging, cf. FIG. 4, which are immersed in the electrolyte for 1.2 m. The current is 1800 A with a cell voltage of 41.9 V.

5 $m^3$ /h electrolyte with a temperature of 62° C. are supplied to the distribution chamber (11); which electrolyte contains 183 g/l free sulfuric acid and 45 g/l copper and has a density of 1170 kg/$M^3$. The amount of recirculated electrolyte flowing through the recirculation chamber (14) to the distribution chamber is 75 $m^3$/h. The electrolyte withdrawn from the cell via line (7) has a residual Cu content of 36 g/l.

We claim:

1. An electrolytic cell for the electrochemical deposition of a metal selected from the group which consists of copper, zinc, lead, nickel and cobalt from an aqueous electrolyte bath containing the metal in ionogenic form, said electrolytic cell comprising:

a trough container for said electrolyte bath with a bottom wall, with side walls, and with at least one inlet and at least one outlet for electrolyte of the bath, said bottom wall and said side walls defining an electrolyte compartment;

a multiple of plate electrodes disposed in the electrolyte compartment of said container and partly immersed in an electrolyte bath, and wherein said electrodes include at least one anode and at least one cathode connected with a direct current source, the bottom wall of the container which is in contact with the electrolyte bath being formed with numerous openings for the passage of the electrolyte;

at least one distribution chamber common to all of the electrodes disposed below said bottom wall for recirculation of said electrolyte, said openings in said bottom wall communicating between said distribution chamber and said compartment;

at least one recirculation chamber formed in at least one of said side walls for recirculating electrolyte from the electrolyte bath into the distribution chamber, the upper portion of the recirculation chamber being connected with the electrolyte bath and the lower portion of the recirculation chamber communicating with the distribution chamber; and openings formed in at least half said electrodes in parts thereof immersed in the electrolyte for passage of said electrolyte.

2. The electrolytic cell as claimed in claim 1 wherein the recirculation chamber is disposed at that side wall of the container which is nearest to the electrolyte outlet.

3. The electrolytic cell as claimed in claim 1 wherein said electrodes are supported on a plurality of said side walls and a plurality of said recirculation chambers are disposed at those side walls of the container on which the electrodes are supported.

4. The electrolytic cell as claimed in claim 1 wherein 1 to 20% of the surface of the bottom wall consists of openings.

5. The electrolytic cell as claimed in claim 1 wherein the cell is equipped with a terminal anode and a terminal cathode as well as with bipolar electrodes electrically connected in series.

6. The electrolytic cell as claimed in claim 1 wherein the lower edges of the electrodes have a distance of 5 to 50 mm from the bottom wall.

* * * * *